US006112493A

United States Patent [19]

Rickman

[11] Patent Number: 6,112,493

[45] Date of Patent: Sep. 5, 2000

[54] CONSERVATORY ROOF CONSTRUCTION

[75] Inventor: Paul Douglas Rickman, Ingatestone, United Kingdom

[73] Assignee: Rickmans Limited, United Kingdom

[21] Appl. No.: 09/270,369

[22] Filed: Mar. 16, 1999

[30] Foreign Application Priority Data

Mar. 24, 1998 [GB] United Kingdom ..... 9806208

[51] Int. Cl.[7] ..... E04B 7/02; E04B 7/16

[52] U.S. Cl. ..... 52/640; 52/90.1; 52/461; 52/465; 52/469; 52/646; 52/655.1; 52/DIG. 17

[58] Field of Search ..... 52/DIG. 17, 646, 52/640, 655.1, 465, 469, 461, 90.1

[56] References Cited

U.S. PATENT DOCUMENTS 4,712,337 12/1987 Marcusse et al. ..... 52/640 X
5,937,590 8/1999 Richardson ..... 52/90.1

*Primary Examiner*—Christopher T. Kent
*Attorney, Agent, or Firm*—Tilton, Fallon, Lungmus & Chestnut

[57] ABSTRACT

A conservatory roof construction with a ridge member, glazing bars or rafters and two hip bars. Each hip bar has a track extending therealong. A connector plate connects to the track and is both slidable along the length thereof and is hingable with respect to a respective hip, glazing bars (or track rafters) which connect with the hip bars being configured to permit the connection of the connector plate thereto.

11 Claims, 3 Drawing Sheets

CONSERVATORY ROOF CONSTRUCTION

FIELD OF THE INVENTION

This invention relates to a roof construction suitable for use with a conservatory, and in particular to a roof having a hip configuration.

BACKGROUND OF THE INVENTION

Conservatory roofs may be constructed in a number of different ways. Traditionally, timber members have been cut on site to the required size and were nailed or screwed together. Glazing was then fitted to the glazing bars extending from a ridge beam down to a wall plate, laid around the upper surface of the conservatory walls. Many modern conservatory roofs are now assembled from pre-formed metal sections, either cut remote from the location at which the roof is to be constructed and then assembled on site, or cut and assembled on site, as appropriate, whereafter multi-wall plastics sheeting is fitted to the glazing bars to complete the roof.

A particular problem arises in the construction of a conservatory having a hip roof. Such a roof usually is formed at an end of a conservatory where there are two parallel spaced-apart walls and a further wall extending at right-angles between the parallel walls. The hip roof has a panel of triangular shape which extends upwardly at an acute angle to the horizontal, from the further wall to the ridge beam. A hip bar extends along the junction between the hip end and the side panels of the roof, and—depending upon the various dimensions of the roof—one or more glazing bars, either on the hip end or the main area of the roof, may need to connect to the hip bars. Such glazing bars are usually referred to as "jack-rafters".

In the case of a hip roof constructed from metal members, a particular problem arises in the connection of the jack-rafters to the hip bar. The precise angle between the upper end of each jack-rafter and the hip bar is difficult to pre-define and it is necessary to provide some kind of adjustable connection, which may be made to the hip bar at the required point, during construction on-site. Typically, an engineered pivoting bracket is employed, which is bolted to the hip bar in a fixed position. Once fixed, it is very difficult to make minor adjustments to the position, if—as frequently occurs—during final assembly of the roof, the jack-rafter is not located precisely where it was anticipated it would be located.

SUMMARY OF THE INVENTION

The present invention aims at overcoming the above-described problem, of constructing a roof including a hip bar and at least one jack rafter having its upper end connected to the hip bar.

According to the present invention, there is provided a roof construction suitable for use in the assembly of a hip roof for a conservatory, which roof construction includes at least one jack-rafter connecting with a hip bar, wherein the hip bar has at rack extending therealong, a connector plate connects to said track and is both slidable along the length thereof and is hingeable with respect to the hip bar, and the connector plate and jack-rafter are configured to permit the upper end of the jack-rafter to be connected to the connector plate.

It will be appreciated that with the roof construction of this invention, the connector plate may slide along the track of the hip bar to a suitable location, during final assembly of the roof. Moreover, since the connector plate may hinge with respect to the hip bar, the assembly permits the fabrication of a wide variety of different roofs, adopting a suitable angle for the particular roof being constructed.

Though the track could be formed separately and then attached to a hip bar even of a different material, most preferably the hip bar is a metal extrusion for example of aluminium alloy and the track is formed integrally therewith. In one embodiment, the track comprises a re-entrant channel formed along one lateral edge of the hip bar. Most preferably, the hip bar has two such tracks extending a long opposed sides thereof, to permit jack-rafters to be connected to the hip bar on both sides thereof.

Conveniently, the re-entrant channel is of part-circular internal cross-sectional shape and the connector plate has a bead also of part circular cross-sectional shape formed along one edge thereof, which bead is slidably interengageable with the re-entrant channel of the hip bar. Such a connector plate may be cut from a length of extruded metal section, again of aluminium alloy, the cut length having a width not greater than the width of the jack-rafter with which the connector plate is to connect. The two cuts which form the connector plate should be parallel and each at a suitable angle to the length of the metal extrusion, such that when assembled with a jack-rafter, the plate itself is substantially aligned with the length of the rafter. Thus, the cut connector plate will be generally of a parallelogram shape, in plan.

A jack-rafter with which the connector plate is to connect preferably defines a slot into which the connector plate is received. Such a slot is advantageously formed during the extrusion of the jack-rafter. For example, the jack-rafter may have a central portion and a pair of wings to each side of the central portion for supporting glazing panels, the slot being defined below the wings.

Once the roof has been assembled with the jack-rafters connected to the hip bar by means of respective connector plates, each connector plate may be secured to the jack-rafter by means of a screw-threaded fastener. There is no need for the connector plate to be secured axially at the required position along the length of the hip bar, though a self-tapping screw could be inserted through a wall of the channel and into the bead of the connector plate.

BRIEF DESCRIPTION OF THE DRAWINGS

By way of example only, one specific embodiment of conservatory hip roof construction in accordance with the present invention will now be described in detail, reference being made to the accompanying drawings, in which.

DETAILED DESCRIPTION OF THE INVENTION

Figure 1:
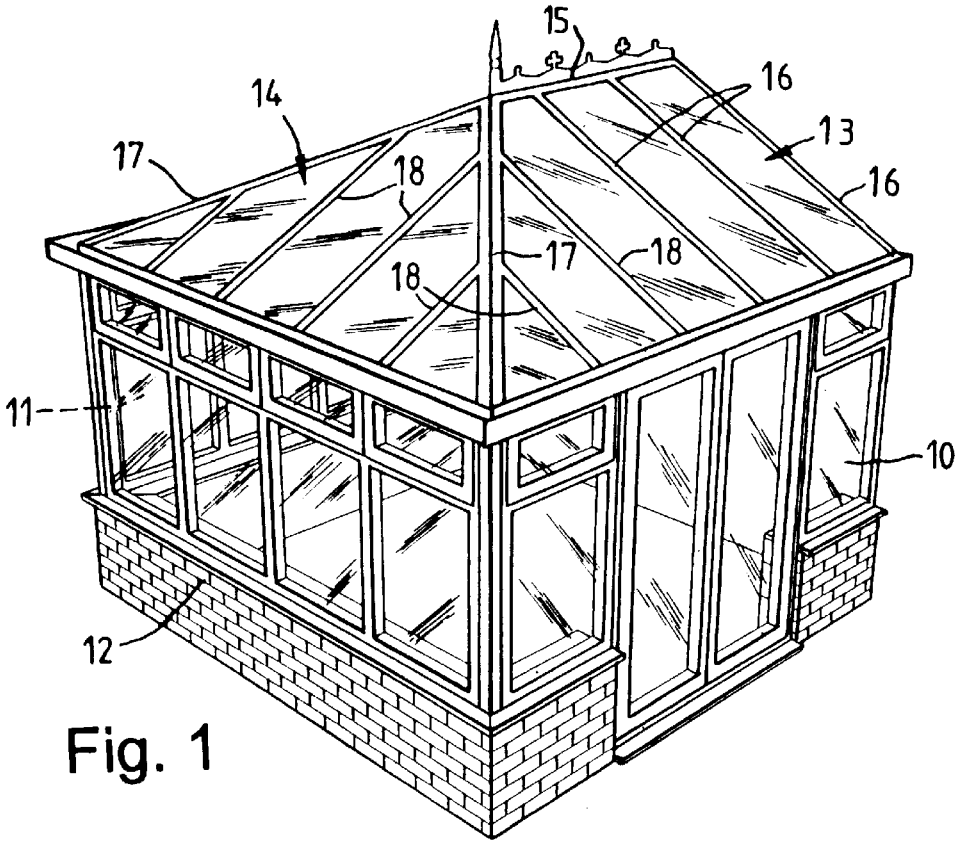
FIG. 1 is a perspective view of a conservatory including a hip roof construction.
Figure 2:
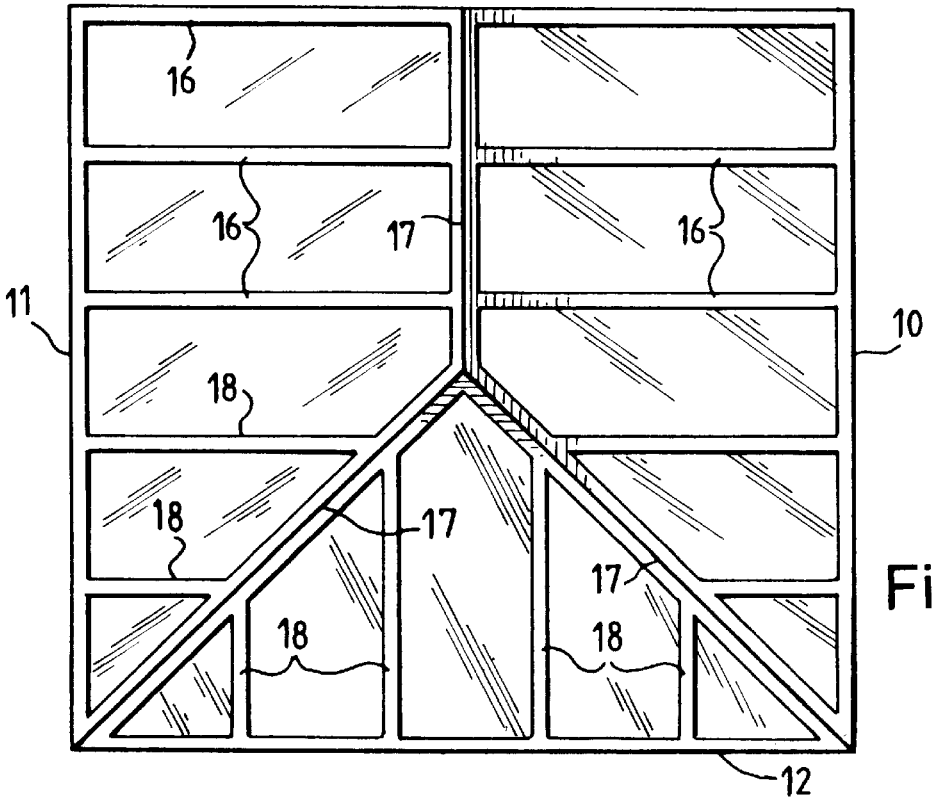
FIG. 2 is a plan view on the roof of the conservatory of FIG. 1.

The conservatory shown in FIG. 1 has two side walls 10 and 11 and an end wall 12. A hip roof construction rests on the top edges of these walls and includes a pair of side panels (only one of which can be seen at 13) and a hip end panel 14. Each panel is fabricated from extruded aluminium members connected together, with glazing panels (for example, of triple wall polycarbonate sheet) supported by the members. The roof includes a ridge member 15, glazing bars (or rafters) 16 and two hip bars 17. The glazing bars which intersect the hip bars are usually referred to as jack-rafters and are shown at 18 in FIGS. 1 and 2.

The angle each jack-rafter 18 makes with its hip bar 17 is a complex function dependent upon the pitch of the roof and the angle the hip bar 17 makes with respect to a horizontal plane. Accordingly, when using pre-formed aluminium alloy extrusions for the construction of the roof, it is difficult to provide a universal bracket which permits a jack-rafter to be connected to its hip bar at the appropriate location and at the appropriate angle.

Figure 3:
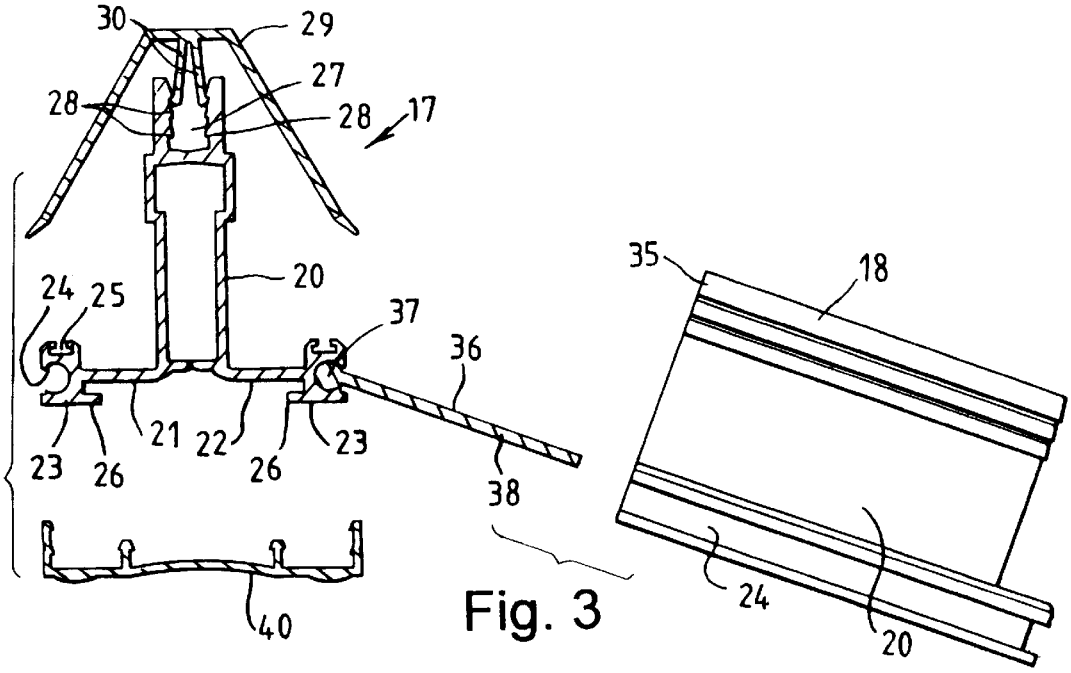
FIG. 3 is a cross-section through the hip bar, connector plate and jack rafter, with the parts partially diassembled for clarity.
Figure 4:
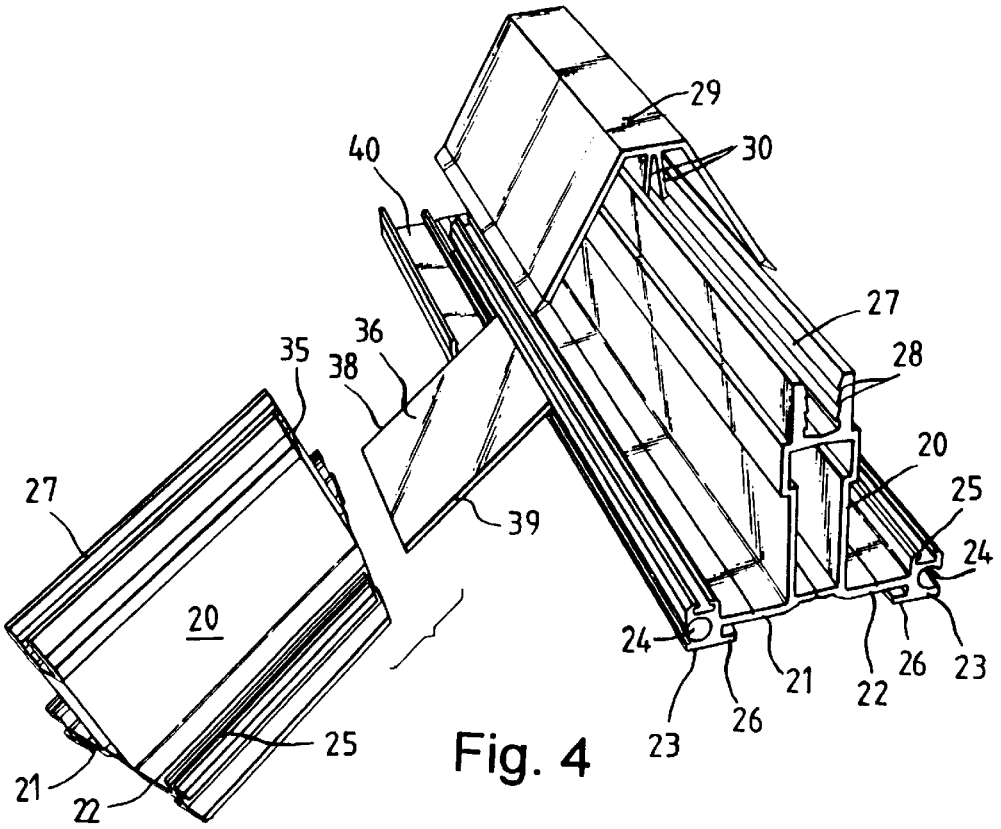
FIG. 4 is a perspective view of a connection between a hip bar and jack rafter, again with parts partially cut away for clarity.

The embodiment of this invention as illustrated in FIGS. 3 and 4 permits a jack-rafter 18 to be connected to its hip bar 17 at a suitable angle for the roof under construction and at a required position along the length of the hip bar 17.

The hip bar 17 comprises a central section 20 having a pair of wings 21 and 22 extending laterally from the lower region of the central section 20. Provided along the outer edge of each wing 21, 22 is a respective track 23 defining a re-entrant channel 24 running along the length of the hip bar 17. The upper surface of each track 23 is formed with a groove 25 within which may be located a seal member (not shown) and on which a glazing panel (also not shown) may rest. Projecting inwardly from the lower region of each track 23 is a lip 26 whereby a slot is formed below the two wings 21, as best seen in FIG. 3.

The upper part of the central section 20 has a channel 27 with ribs 28 formed therealong. A plastic material capping strip 29 overlies the hip bar 17 and has toothed legs 30 which are received in the channel 27, the capping strip 29 being retained in position by the interengagement of the teeth of legs of 30 with the ribs 28 of channel 27. The free outer edges of the capping strip 29 are formed as resilient seals each to bear on the upper surface of a respective glazing panel (not shown) supported by the hip bar 17.

The jack-rafters 18 are of essentially the same section as the hip bar 17 though there is no need for a re-entrant channel to be formed along the edges of the wings 21 and 22. However, identical sections may be employed for the jack-rafters 18 and the hip bars 17 and thus the jack-rafters may include the re-entrant channel. Each jack-rafter is cut so that its end face 35 extends at an appropriate angle having regard to the roof under construction and is then connected to its hip bar by means of a connector plate 36, the main area of which is received in the slot defined below the wings 21 and 22 by the lips 26. Each connector plate 36 has a main area which is provided with a bead 37 along one edge and essentially of circular cross-sectional shape, which bead is a free sliding fit within the re-entrant channel 24 of the track 23. Thus, the plate 36 may rotate about the axis of the bead 37 through a predefined angle of typically about 60° and also may slide along the length of the hip bar to a required position.

Figure 5:
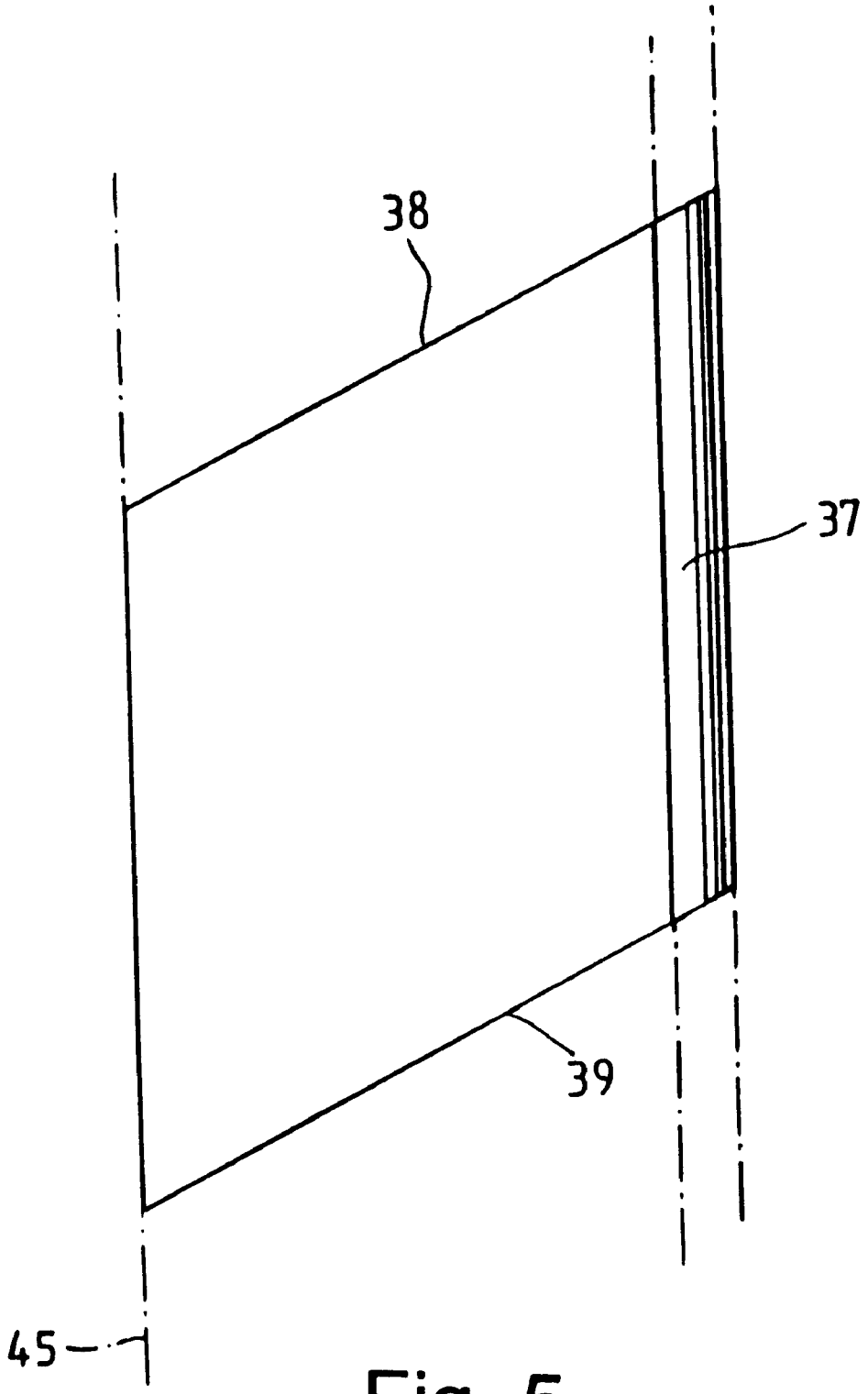
FIG. 5 is a plan view on the connector plate.

Each connector plate employed in the roof construction may be cut from an aluminium alloy extrusion 45 of a suitable section, as shown in FIG. 5. The plate should be cut with the side edges 38 and 39 at the appropriate angle to the length of the extrusion 45 such that when assembled with a jack-rafter, the cut edges are parallel to length of the jack-rafter. Thus, the plate 36 has the shape of a parallelogram with the included angle between adjacent sides equal to the angle between a jack-rafter and its hip bar.

In order to assemble a roof using the connector plates as described above, a reasonable estimate of the angle between adjacent sides of the connector plate is made and then the connector plate is engaged with the track 23 and is slid to an appropriate position. A jack-rafter is pushed into engagement with the connector plate by locating the main area of the plate in the slot beneath the wings of the rafter and the final position of the connector plate is adjusted both rotationally and along the length of the hip bar, for the roof being assembled. Then, the connector plate is secured to the jack-rafter for example by means of a nut and bolt or a self-tapping screw passing through both the connector plate and the central region of the jack-rafter.

Once completed, the underside of the hip bar may be given an aesthetically pleasing appearance by snap-fitting a plastics valence trim to the section, such as trim 40 shown in FIG. 3. Similar trims may be fitted to the undersides of the jack-rafters 18 and glazing bars 16.

I claim:

1. A roof construction, comprising:

(i) a hip bar;

(ii) at least one jack rafter;

(iii) said hip bar defining a track extending therealong;

(iv) a unitary connector plate having a connection means at one end received in said track of said hip bar, whereby said unitary connector plate is both slidable along the length of said track and hingeable with respect to said hip bar; and (v) said jack-rafter defining a slot for receiving the opposite end of said connector plate by sliding in a direction parallel to the length of the jack-rafter, whereby the connector plate is received within said jack-rafter.

2. A roof construction as defined in claim 1, wherein said hip bar is a metal extrusion and said track is formed integrally therewith.

3. A roof construction as defined in claim 2, wherein said track comprises a re-entrant channel formed along one lateral edge of said hip bar.

4. A roof construction as defined in claim 2, wherein said track comprises a re-entrant channel formed along one lateral edge of said hip bar and wherein said re-entrant channel is of part-circular internal cross-sectional shape.

5. A roof construction as defined in claim 4, wherein said connector plate has a bead formed along one edge thereof, and wherein said bead is interengageable with said re-entrant channel of said hip bar.

6. A roof construction as defined in claim 1, wherein said connector plate is cut from a length of extruded metal section to have a width not greater than the width of said jack-rafter.

7. A roof construction as defined in claim 6, wherein said connector plate is generally of a parallelogram shape, in plan.

8. A roof construction as defined in claim 1, wherein said jack-rafter defines a slot into which said connector plate is received.

9. A roof construction as defined in claim 8, wherein said jack-rafter is a metal extrusion and said slot is formed in the extrusion.

10. A roof construction as defined in claim 8, wherein said jack-rafter is a central portion and a pair of wings to each side of said central portion for supporting glazing panels, the said slot being defined below said wings.

11. A roof construction as defined in claim 1, wherein a screw-threaded fastener connects said connector plate to said jack-rafter.

* * * * *